US006070384A

United States Patent [19]

Chich

[11] Patent Number: 6,070,384

[45] Date of Patent: Jun. 6, 2000

[54] HIP AND RIDGE ROOFING SHINGLE

[75] Inventor: Adem Chich, Kearney, N.J.

[73] Assignee: Building Materials Corporation of America, Wayne, N.J.

[21] Appl. No.: 08/862,341

[22] Filed: May 23, 1997

[51] Int. Cl.[7] ..... E04D 1/30

[52] U.S. Cl. ..... 52/518; 52/57; 52/528; 52/555

[58] Field of Search ..... 52/57, 518, 526–528, 52/555, 560, 276, 748.1, 540

[56] References Cited

U.S. PATENT DOCUMENTS

| | | | |
|---|---|---|---|
| 420,707 | 2/1890 | Carroll | 52/276 |
| 1,885,346 | 11/1932 | Harshberger | 52/527 |
| 2,513,448 | 7/1950 | Brunnzell | 52/527 X |
| 2,674,765 | 4/1954 | Tennison | 52/62 X |
| 3,913,294 | 10/1975 | Freiborg | 52/518 |
| 4,322,928 | 4/1982 | Freiborg | 52/545 X |
| 4,434,589 | 3/1984 | Freiborg | 52/748.1 X |
| 4,671,037 | 6/1987 | Bienvenu | 52/526 |
| 5,247,771 | 9/1993 | Poplin | 52/555 X |
| 5,365,711 | 11/1994 | Pressutti et al. | 52/555 X |
| 5,375,388 | 12/1994 | Poplin | 52/518 X |
| 5,471,801 | 12/1995 | Kupczyk et al. | 52/57 |
| 5,495,654 | 3/1996 | Goodhart et al. | 52/530 X |

*Primary Examiner*—Carl D. Friedman
*Assistant Examiner*—Winnie S. Yip
*Attorney, Agent, or Firm*—William J. Davis; Marilyn J. Maue

[57] ABSTRACT

This invention relates to a non-perforated, essentially orthogonal hip and ridge shingle having stepped side portions which shingle is foldable along its longitudinal axis over the ridge of a pitched roof and is additionally foldable upon itself on a plane perpendicular to its longitudinal axis.

14 Claims, 3 Drawing Sheets

HIP AND RIDGE ROOFING SHINGLE

FIELD OF THE INVENTION

This invention pertains to a hip and ridge shingle capable of being folded upon itself on a plane perpendicular to its longitudinal axis.

BACKGROUND OF THE INVENTION

Several asphaltic ridge shingles of various shape and folding patterns have been proposed for covering peaks of pitched or gabled roofs to provide a pleasing appearance which simulates more expensive roofing material. (The term "ridge shingle" is used herein in a broad sense to refer to ridge shingles, hip shingles and the like, and it is understood that the term applies to all such roofing covers.) For example, Freiborg, U.S. Pat. No. 3,913,294, teaches a tapered asphalt ridge cover comprising a plurality of folds perpendicular to, and approximately midway down the longitudinal axis of the ridge cover with a fold at the front end to produce a small lip and asphalt adhesive on the lower surface of the front end. Poplin, U.S. Pat. No. 5,247,771, teaches a ridge cover with first and second tapered portions in which the cover is formed by folding the unit such that the second tapered portion overlaps the first tapered portion.

Pressutti et al., U.S. Pat. No. 5,365,711, teach a ridge cover composed of a particular composition containing a flexibility additive in which the roofing sheet is folded back on itself twice in the intermediate portion of the sheet so as to form a thickened portion midway the length of the sheet with thinner sections extending forwardly and rearwardly from the thickened portion. The ridge cover further comprises a T-shaped slit extending through the thickened portion of the unit.

For the most part, such ridge shingles are cut from asphaltic sheets to provide shingle units having tapered side portions, as shown in U.S. Pat. Nos. 5,471,801; 5,375,388; 5,247,771 and 4,434,589. However, manufacture of these units poses several problems, predominantly associated with the cutting operation in continuous in-line manufacturing processes. Tapered edges are difficult to cut since the tapered edge tends to "walk" when contacted with the cutting blade. This induces tearing at the cutting site and introduces a degree of non-uniformity among the shingle units produced. The manufacture of these may further be wasteful of materials due to the angled nature of the units.

Accordingly, it is an object of this invention to overcome this difficulty and to produce improved ridge shingles having relatively uniform edges resistant to tear and deformation. Another object of this invention is to provide a thickened ridge which is resistant to wind uplift. Another object of the invention is to provide a convenient indicator for uniform overlapping of a succeeding shingle unit during installation of a roof ridge. Another object of this invention is to provide for the manufacture of such improved ridge shingles by economical and commercially feasible methods, both in batch processes and continuous in-line processes. Another object of the invention is to provide a shingle which can simulate the aesthetic appearance of wood shingles, but without the problems associated with wood shingles, such as building code restrictions and flammability.

SUMMARY OF THE INVENTION

In accordance with this invention, there is provided a basically rectangular or orthogonal, single-ply shingle unit, capable of being folded along its longitudinal axis, having stepped or notched top and bottom marginal edges and a central portion comprising a overlayer area and a fold area where the unit is capable of being folded a plurality of times upon itself on a plane perpendicular to its longitudinal axis, so as to form a multiply-folded leading edge of the shingle unit in the fold area extending from a first notched portion of the shingle unit, and a longer, unfolded second notched portion overlaying the first portion and extending from the opposite side of the central portion to form the trailing edge of said shingle unit.

BRIEF DESCRIPTION OF THE DRAWINGS

For a better understanding of the invention, including alternative embodiments thereof, the description herein is to be read in conjunction with the accompanying drawings of which.

DETAILED DESCRIPTION OF THE INVENTION

The present invention comprises a basically orthogonal, single-ply shingle unit, capable of being folded along its longitudinal axis, having stepped or notched top and bottom marginal edges and a fold area, where the unit is capable of being folded a plurality of times upon itself on a plane perpendicular to its longitudinal axis so as to form a multiply-folded leading edge of the shingle unit in the fold area starting at a first notched portion of the shingle unit and overlaying the first notched portion, and a longer, unfolded second notched portion extending from the opposite side of the fold area to form the trailing edge of said shingle unit. In one embodiment of the invention, the shingle unit may additionally comprise one or more fold areas situated in the second notched portion of the unit.

By describing the shingle unit as basically orthogonal, it is meant that the angles formed by the edges of the various notches relative to the top and bottom edges of the notched portions and the mid portion are essentially perpendicular (i.e., 90 degree angles), and the top and bottom edges of the various portions are essentially parallel to each other and to those of the other portions.

The ridge shingle of the present invention comprises a sheet of roofing material of orthogonal shape comprising a central portion comprising a fold area and a overlayer area, a first notched portion and a second notched portion, the first and second notched portions extending from opposite ends of the central portion along a longitudinal axis of the central portion, with a plurality of fold lines along axes perpendicular to the longitudinal axis in the fold area. The first and second notched portions have connecting ends at which they are, respectively, connected to the central portion, and free ends at their outer extremities (d and e, in FIG. 1). At least one set of the fold lines is situated within the fold area of the central portion proximate to the first notched portion, such that when the shingle is folded upon itself to form a plurality of folds, the first notched portion forms an underlayer base, the folds form a forward elevated or thickened portion, the overlayer area forms a cover extending rearwardly over the base creating a double coverage area, and the second notched portion forms a trailing portion. The invention can be further understood by reference to the Figures.

Figure 1:
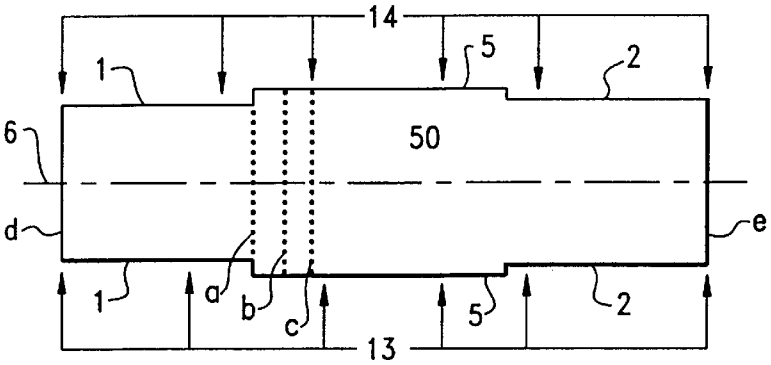
FIG. 1 illustrates a top plan view of the unfolded hip and ridge shingle unit of the invention.

Referring to FIG. 1, a preferred embodiment of hip and ridge shingle unit 50 of the present invention is shown, wherein the unit is preferably cut from a roll of commercially available asphalt roofing material. The under surface of the first notched portion and/or that of the distal end of the second notched portion may be coated with an adhesive to aid in secure installation of the ridge shingle.

According to FIG. 1, unit 50 overall is of generally rectangular shape, except for central portion 5, from which extend first and second notched portions 1 and 2, respectively, at longitudinally opposing sides of the fold area. Accordingly, both bottom horizontal edge 13 and top horizontal edge 14 depict top and bottom edges of a stepped or notched configuration. The first notched portion 1, the second notched portion 2 and the central portion 5 are individually generally rectangular shaped. The longitudinal axis of the shingle unit is indicated by broken line 6. In FIG. 1, fold lines (a), (b) and (c) are indicated by dotted lines which transverse the longitudinal axis at approximately a 90 degree angle; the fold lines a, b and c are positioned in the fold area of the central portion 5 progressively further from the first notched portion 1.

Figure 2:
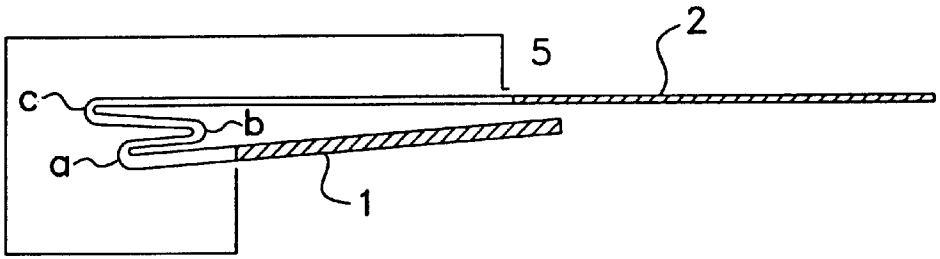
FIG. 2 shows a side view of the shingle unit folded along the tranverse

FIG. 2 illustrates by side view the shingle unit folded three times upon itself in the fold area of central portion 5 to provide two forward folds (a) and (c) and one rearward fold (b) as defined by their respective fold lines. As shown, first notched portion 1 forms a base or underlayer of the folded shingle and is overlapped by the overlayer area of central portion 5 which forms an area of double coverage. Second notched portion 2 extends a distance beyond the free end of notched portion 1 and forms the trailing end of the shingle. Alternatively, when folded, the first notched portion may extend beyond the free end of the second notched portion or they may be co-terminus. In FIG. 2, the first and second notched portions, recessed or notched relative to the central portion 5, are indicated by shading as opposed to the unshaded fold area.

In the present invention, folds a, b and c are preferably situated in the central portion within a fold area proximate to the first notched portion; more preferably, the first fold line a is defined by the border of central portion 5 and first notched portion 1. The folding pattern creates a laterally asymmetrical configuration in the shingle. The orthogonal shape of the shingle unit and the folding pattern are found to create a form comparable to that of wood shingles when the shingles are installed as on a roof ridge or hip. In addition, the folding pattern provides sites for securing the shingle to the roof and provides an elevated portion which risks bending by wind or other forces.

The present invention provides a convenient indicator for uniform overlapping of successive shingle units during installation of a roof ridge. This is accomplished through alignment of the front folded edge of one shingle with the notch cut in the top (i.e., the second notched portion) of the previously installed shingle. This allows for proper alignment and spacing of the shingle units and provides for a readily accomplished uniform application.

Figure 3:
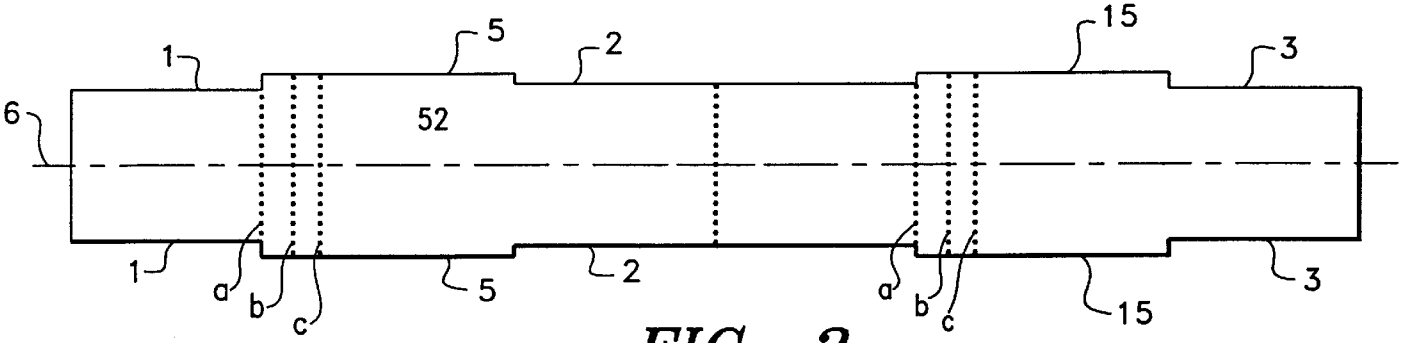
FIG. 3 shows a top plan view of an alternative unfolded shingle unit of this invention.

FIG. 3 illustrates another embodiment of the invention comprising essentially two or more individual shingle "units" in a single piece of roofing material. According to FIG. 3, sheet 52 comprises first notched portion 1, first central portion 5, with fold lines a, b, and c, and second notched portion 2. In this embodiment, second notched portion 2 is contiguous with a second central portion 15, with fold lines a', b' and c', which second central portion 15 in turn connects to terminal notched portion 3. The longitudinal axis is indicated by broken line 6. Second notched portion 2, in this embodiment, is of sufficient length to form the overlapping cover function of its counterpart in FIG. 1 and the underlying base portion of its counterpart in FIG. 1. The embodiment illustrated in FIG. 3 comprises the equivalent of two shingle units of the type shown in FIG. 1; though additional "units" could be incorporated into a single sheet of roofing material according to the invention. When folded, sheet 52 appears to comprise two (or more, as appropriate) shingle units, each such "unit" being folded according to the description set forth above in connection with FIG. 1 and FIG. 2.

Figure 4:
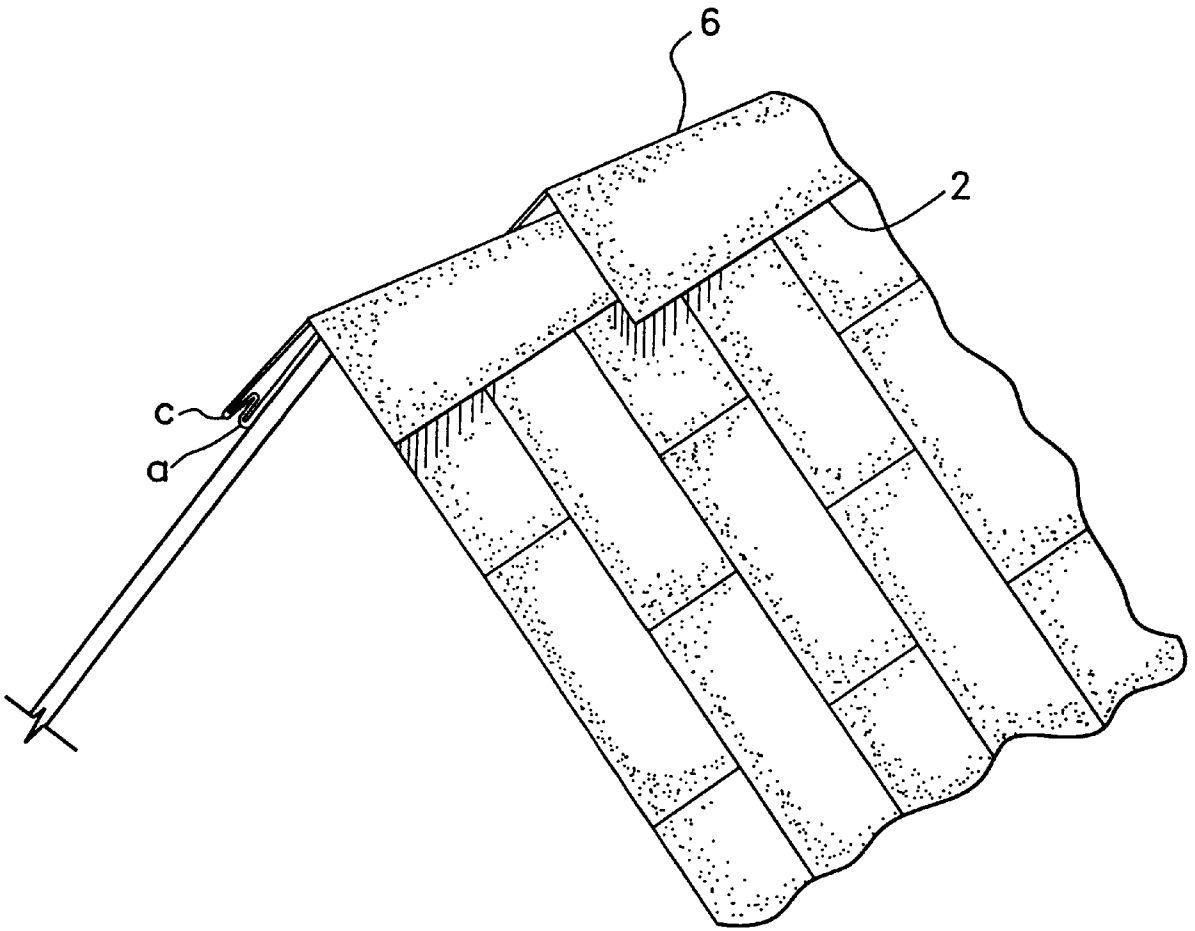
FIG. 4 illustrates a plurality of shingle units installed in series on the ridge of a pitched roof ridge.

FIG. 4 illustrates a series of shingle units described in FIG. 1 when folded over a roof ridge at the longitudinal fold line 6.

In general, the shingle unit of the invention has an overall length of between about 18 and about 36 inches, preferably about 25 to about 32 inches, most preferably about 28¾ inches, and a width at the end notched portions of from about 4 to about 14 inches, preferably about 7 to about 11 inches, most preferably about 8 to about 10 inches. It is understood that, in the embodiment as illustrated in FIG. 3, the overall length of the sheet will be generally a multiple of that of the "units" comprising the sheet. Preferably the first notched portion is about 1 to about 3 inches narrower than the central portion, more preferably about 1½ inches narrower (about ¾ inch inset on each side) than the central portion, and the second notched portion is about 1 to about 3 inches narrower that the central portion, more preferably about 1 inch narrower (about ½ inch on each side) than the central portion.

In one embodiment of the present shingle, the width of the first notched portion is about 6 to about 6½ inches and the length is about 8 to about 8½ inches; the central portion has a width of about 8 inches and a length of about 11 to about 12 inches. The second notched portion is between about 7 to about 7½ inches wide and has a length of about 9 to about 10 inches. In another embodiment, the width of the first notched portion is about 8 to about 8½ inches and the length is about 8 to 8½ inches; the central portion has a width of about 10 to about 10½ inches and a length of about 11 to about 12 inches. The second notched portion is between about 9 to about 9½ inches wide and has a length of about 9 to about 10 inches. It is understood that the shingle unit may be formed in other dimensions as readily determinable by those skilled in the art.

In a preferred embodiment, the first notched portion is of sufficient length relative to the central portion that, when folded, the first notched portion ends at or about the notch line of the second notched portion. However, the length of the first notched portion is variable and may be made as long as desired for any given application. Generally, to make efficient use of materials, the first notched portion, when folded, does not extend to or beyond the free end of the second notched portion, and preferably ends at or about the connected end of the second notched portion (i.e., at the notch of the second notched portion).

Preferably, the vertical folds of the shingle unit are located in the forward half section of the central portion in the fold area, proximal to the first notched portion, to allow for complete overlapping of first notched portion 1 by the central portion 5, particularly by the overlayer area of the central portion. In a preferred embodiment, the fold line a is defined by the border between the central portion and the first notched portion. Most desirably, vertical fold (c) is extended beyond vertical fold (a) by decreasing the distance between fold (a) and fold (b) relative to that between fold (c) and fold (b). Preferably, the width of fold portion a-b is less than or equal to than the width of fold portion b-c, and when folded, the length d-c is less than length c-e. Preferably, the degree of overhang of the upper (b-c) fold over the lower (a-b) fold, i.e., the difference between the width of a-b and b-c, is 0 to 1 inch, more preferably about ⅛ to about ⅜ inches; most preferably approximately about ⅛ inches. The invention is not limited by the dimensions set forth herein; these are preferred embodiments. They may be modified within the scope of the invention by those skilled in the art.

Figure 5:
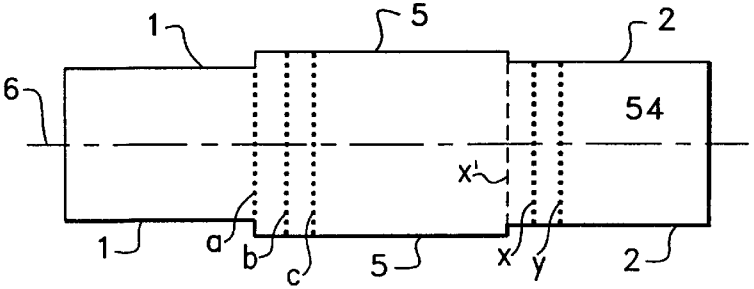
FIG. 5 illustrates a top plan view of another alternative unfolded shingle unit of this invention.

In another embodiment of the invention as illustrated in FIG. 5, the shingle unit 54 comprises a first notched portion 1, a central portion 5, and a second notched portion 2, with a longitudinal axis 6. Fold lines a, b and c are positioned perpendicularly to the longitudinal axis 6 essentially as described in relation to FIG. 1. In addition, however, in this embodiment of the invention, additional fold lines x and y are positioned at the forward portion of notched portion 2 proximate to the overlayer of central portion 5 and progressively further therefrom. The border between central portion 5 and second notched portion 2 defines a line x' (broken line x' in FIG. 5). The distance x'-x may be 0 to about 3 inches, preferably 0 to about 2 inches. When the distance is zero (0), then the first fold line x is at position x'. The width of the fold portions x'-x and x-y may be as described in relation to fold portions a-b and b-c, above. The folds may be of equal dimensions, preferably about 1 to about 2 inches wide, more preferably about 1 inch wide.

The second notched portion 2 of this embodiment will preferably be longer than in the embodiments shown in FIG. 1. Preferably, the length of the second notched portion 2 will be about 11 to about 12 inches. The length of the second notched portion should preferably be sufficient, when in use, to provide an adequate tail end for affixing to the roof structure and for resting below the front folded end of the adjacent shingle unit.

When folded, as for use on the hip or ridge of a roof, the shingle unit of this embodiment has three folds and four thicknesses of shingle material about the three fold lines in the fold area of central portion 5 of the shingle unit, and two folds and three thicknesses of shingle material about the three fold lines in the frontward portion of the notched portion 2 of the shingle unit. When applied to a roof hip or ridge, the front edge of one shingle is placed over and aligned with the second elevated portion of the preceding shingle. This embodiment provides an effective alignment tool to aid in applying the shingles and it provides improved aesthetic value through the further elevation of the leading edge of the shingles. The second fold area further provides a useful nailing area which may be approximately 1 inch in width.

Figure 6:
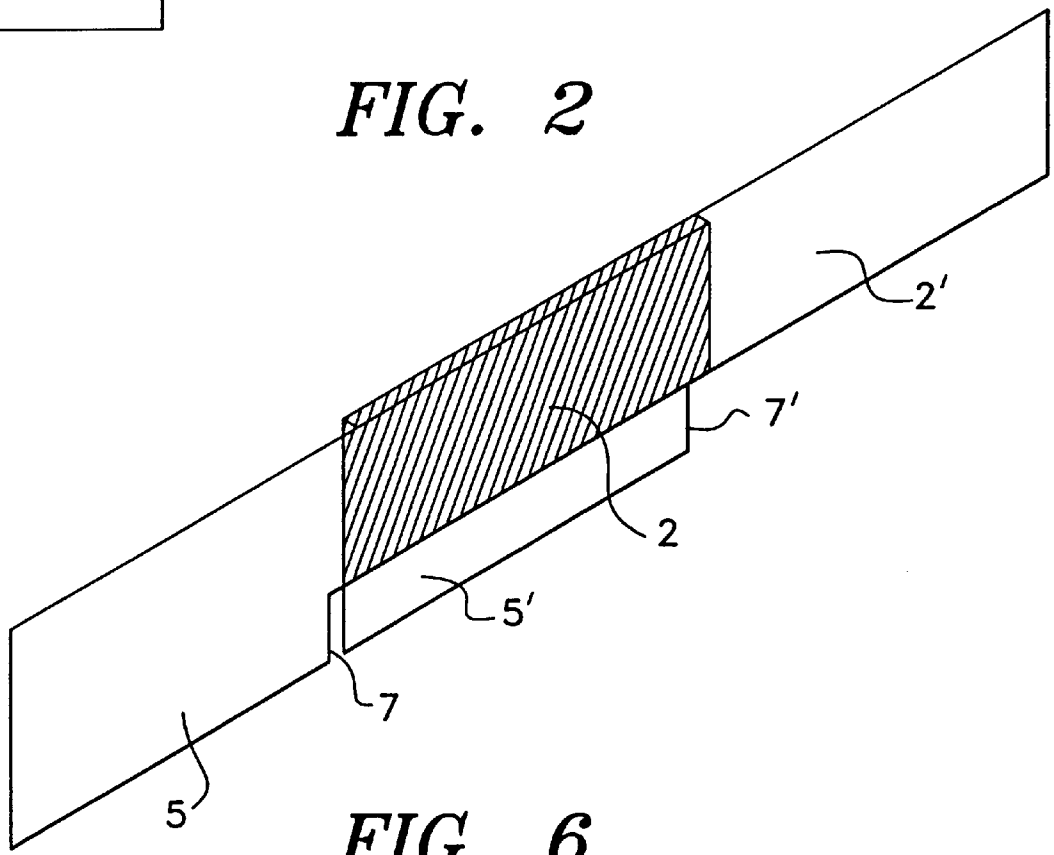
FIG. 6 illustrates a side view, at a 30° angle, of two shingle units, the second unit overlapping the first unit.

FIG. 6 illustrates a side view of two successive and overlapping shingle units, viewed at a 30° angle. In this perspective, the overlayer area of central portion 5 is visible on the first shingle. Both the overlayer area of the central portion 5' and the second notched portion 2' are visible on the second overlapping shingle. The shaded area on FIG. 6 represents the second notched portion 2 of the first shingle which is substantially covered by the central portion 5' of the second shingle. The forward edge of the second shingle unit is shown as being aligned essentially with the notch 7 in the first shingle unit. The notch 7' in the second shingle unit is also shown.

The invention has been described in detail with respect to preferred embodiments. These embodiments,however, are merely for example only and the invention is not restricted to such examples. It will be readily understood by those skilled in the art that modifications can be made within the scope of the invention as claimed.

What is claimed is:

1. A ridge shingle of orthogonal shape comprising a central portion comprising a forward fold area joined to a rearward overlayer area, an unfolded, longitudinally elongated first forward notched portion proximate said fold area and a second notched portion proximate said overlayer area, each notched portion having a free end and a connecting end, said first and said second notched portions extending from opposite ends of said central portion along a longitudinal axis of said central portion, said fold area having at least three fold lines consisting of a first fold line (a), a last fold line (c) and at least one intermediate fold line (b) between said first and last fold lines, said fold lines positioned along axes perpendicular to said longitudinal axis, of said shingle, said first fold line being situated within said fold area proximate to said first notched portion, and said last fold line in said fold area being situated proximate a forward portion of said overlayer area of said central portion, such that when said shingle is folded back upon itself to form a plurality of folds, said first notched portion forms a base, placed underlaying the central portion said folds form a forward elevated portion, and said overlayer area of said central portion and said second notched portion form an overlaying layer extending rearward over the entire length of said base.

2. The shingle of claim 1 comprising three said folds along said three fold lines a, b, and c, wherein said intermediate fold line (b) is intermediate between a first fold line (a) and said last fold line (c), said three folds are positioned progressively further from said first notched portion, such that a distance between said intermediate fold line (b) and said last fold line (c) is equal to or less than a distance between said first fold line (a) and said intermediate fold line (b), such that when said shingle is folded back upon itself forming said three folds, an area formed between said intermediate fold (b) and said last fold line (c) is even with or overhangs an area formed between said first fold line (a) to said intermediate fold line (b).

3. The shingle of claim 2 wherein the distance from fold line c to said free end of said first notched portion is less than the distance from fold line c to said free end of second notched portion.

4. The shingle of claim 1 further comprising three folds along a third fold line (x) and a second fold line (y) both located in said second notched portion proximate to said central portion and positioned progressively further from said central portion, and a fourth fold line (x') adjacent said third fold line (x) defined by the border between said central portion and said second notched portion, such that a distance between said fourth fold line (x') and said third fold line (x) is equal to or less than a distance between said third fold line (x) and said second fold line (y) at the second notched portion.

5. The shingle of claim 4 wherein the distance between said fourth and said third fold lines x' and x is 0 to about 3 inches.

6. The shingle of claim 5 wherein the distance between said fourth and third fold lines x' and x is 0 to about 2 inches.

7. The shingle of claim 1 wherein said first notched portion and said second notched portion are of narrower width than said central portion.

8. The shingle of claim 7 wherein the width of said first notched portion is less than or equal to the width of said second notched portion.

9. The shingle of claim 8 wherein said shingle has a longitudinal length in the range from about 18 to about 36 inches, and the width of said first notched portion and said second notched portion is in the range from about 4 to about 14 inches.

10. The shingle of claim 9 wherein the length of said shingle is about 25 to about 32 inches.

11. The shingle of claim 10 wherein the length of said shingle about 28¾ inches.

12. The shingle of claim 9 wherein the width of said first notched portion is in the range from about 6 to about 6½ inches, the width of said central portion is about 8 to about 8½ inches, and the width of said second notched portion is in the range from about 7 to about 7½ inches.

13. The shingle of claim 1 wherein said shingle is capable of being folded along said longitudiunal axis.

14. A ridge shingle comprising a first notched portion, a first central portion comprising a first fold area and a first overlayer area, a second notched portion, a second central portion comprising a second fold area and a second overlayer area, and a third notched area, said first and second notched portions extending from opposite ends of said first central portion along a longitudinal axis of said first central portion, with a plurality of fold lines in said first fold area along axes perpendicular to said longitudinal axis, and said second notched portion and said third notched portion extending from opposite ends of said second central portion along a longitudinal axis of said second central portion, with a plurality of fold lines in said second fold area along axes perpendicular to said longitudinal axis, wherein at least one set of said fold lines in said first fold area is situated within said first fold area proximate to said first notched portion and one set of of said fold lines in said second fold area is situated within said second fold area proximate to said second notched portion, such that when said shingle is folded upon itself to form a plurality of folds, said first notched portion forms a base, placed underlaying the central portion said folds in said first fold area form a forward elevated portion, said first overlayer area and a portion of said second notched portion form an overlayer extending rearward over said base, a second portion of said second notched portion form a second base, said folds in said second fold area form a second elevated portion, and said second overlayer area and said third notched portion form an overlayer extending rearward over said second base.

* * * * *